United States Patent [19]

Doyle et al.

[11] 4,195,278

[45] Mar. 25, 1980

[54] HIGH VOLTAGE TERMINAL STRUCTURE AND FLYBACK TRANSFORMER

[75] Inventors: Richard F. Doyle, Corfu; Edward T. Myers, Tonawanda, both of N.Y.

[73] Assignee: GTE Sylvania Incorporated, Stamford, Conn.

[21] Appl. No.: 3,166

[22] Filed: Jan. 15, 1979

[51] Int. Cl.[2] ..... H01F 27/04

[52] U.S. Cl. ..... 336/90; 336/192; 339/263 R

[58] Field of Search ..... 339/263 R, 272 A, 278 A, 339/115 R, 115 C; 336/90, 192; 310/71

[56] References Cited

U.S. PATENT DOCUMENTS

| | | | |
|---|---|---|---|
| 3,150,909 | 9/1964 | Dererell | 339/272 A X |
| 4,089,576 | 5/1978 | Barchet | 339/263 R X |

*Primary Examiner*—Thomas J. Kozma

*Attorney, Agent, or Firm*—Theodore D. Lindgren

[57] ABSTRACT

A high voltage terminal with a television receiver flyback transformer and other high voltage circuit components enclosed in a resin-filled, non-conductive container, the terminal comprised of a conducting tab partially surrounded by a plastic casing positioned to allow drilling from outside the container through primarily plastic materials and also comprising a conducting pin inserted in the hole to provide electrical contact with the tab.

2 Claims, 3 Drawing Figures

HIGH VOLTAGE TERMINAL STRUCTURE AND FLYBACK TRANSFORMER

TECHNICAL FIELD

This invention relates to a high voltage terminal structure for use with a flyback transformer and with associated components comprising a part of the high voltage circuit of a television receiver.

BACKGROUND ART

A television receiver circuit requires a source of high direct-current voltages for connection to the cathode ray tube for the purposes of beam acceleration and of beam focusing. Voltages having values as large as 32 Kilovolts, for example, are generated through use of a circuit comprised of a flyback transformer, diodes, capacitors and resistors which converts the horizontal retrace pulses to direct current voltage.

A typical flyback transformer used in a high voltage circuit is comprised of a primary winding, optional auxiliary windings and a high voltage secondary winding. The secondary winding may be comprised of a plurality of series connected winding units connected through diodes. One end of the secondary winding is commonly coupled to a reference potential such as ground, the coupling sometimes made through a beam-current-sensing resistor. The other end of the secondary winding may be connected through a diode to a high-voltage terminal which, in turn, may be coupled through a high voltage lead to the cathode ray tube. The high-voltage terminal may also be connected to a capacitor and a bleeder resistor which are also coupled to reference potential. A focusing voltage or voltages may be tapped from the bleeder resistor and connected to an additional high voltage terminal or terminals for subsequent connection to the cathode ray tube and necessary filtering capacitors.

In order to minimize the probability of conduction paths being created by arcing, the mechanical construction of the high voltage circuit requires that those components which are charged during operation to high voltage potential be isolated to the maximum possible extent from components which are maintained at low potential. The design also requires that high voltage circuit components be surrounded where possible by non-conducting materials other than air, particularly where such components have small dimensions or sharply pointed configurations toward which free electrons in air might be attracted at speeds which cause break down or ionization of polarized molecules present in air.

The number of circuit components which require physical isolation from the television receiver chassis may be decreased, for example, by constructing the flyback transformer and the bleeder resistor in the same housing or container. Preferably, the container is constructed with high voltage output terminals located on surfaces of said container remote from that surface having low voltage terminals. The container is typically filled with an insulating material with high voltage breakdown characteristic. For example, non-conducting oil is commonly used in conjunction with a sealed metal container. Another insulating material commonly used is a synthetic resin which is poured under vacuum in liquid form to fill the open plastic container surrounding the high voltage circuit components. The synthetic resin is subsequently solidified by means of a curing process requiring temperature cycling.

Design and fabrication of the high voltage output terminals of such high voltage components presents particular difficulty. An external terminal on the container may, for example, be eliminated completely by internally connecting the high voltage lead or leads prior to filling or sealing said container. One problem with the use of that procedure is the necessity for sealing the container at the point of exit from said container to prevent liquid insulating material from escaping. Another problem results from the fact that the high voltage lead is exposed to damage by handling during production, shipping and assembly processes. It is, therefore, preferable to provide a high voltage terminal which may be located on a surface of the container remote from that surface having low voltage terminals, which does not allow leakage of insulating materials and which permits connection of high voltage leads during the final assembly stage of television receiver production.

DISCLOSURE OF THE INVENTION

The high voltage terminal of this invention is comprised in part of a metal tab which is electrically coupled to the high voltage end of the transformer secondary and/or the bleeder resistor and which is positioned inside an open-end component container at a predetermined location. A plastic casing partially surrounds the tab and is dimensioned such that when the tab and casing are positioned in the container, one surface of the casing will be located adjacent to an interior surface of the container. The positions of the metal tab and the casing are such that at least one surface of the tab is substantially parallel to an exterior surface of the container. A conducting pin or screw is located in a hole which extends from the outer surface of the container to the tab, providing a direct electrical conduction path between the tab and an externally connected high voltage wire. A high temperature grease fills voids between the conducting pin and adjacent surfaces of the hole.

The structure of the terminals provides ease of assembly without expensive tooling and labor. During fabrication, the tabs and casing are positioned in the container prior to filling and curing of synthetic resin material. After curing, a hole is drilled from the outer surface of the container through the tab and the plastic casing. The structure minimizes the amount of cured resin necessary for the drill bit to pass through during the drilling operation and therefore eliminates excessive wear of the drill bit.

The conducting pin is driven into the hole, thereby making electrical contact with the tab, and providing a means for connection of the high voltage lead at a final stage of the television receiver production and therefore eliminating any possibility of damage which may be caused by handling of the high voltage component with said lead attached.

PREFERRED MODE EMBODYING THE INVENTION

Figure 1A:
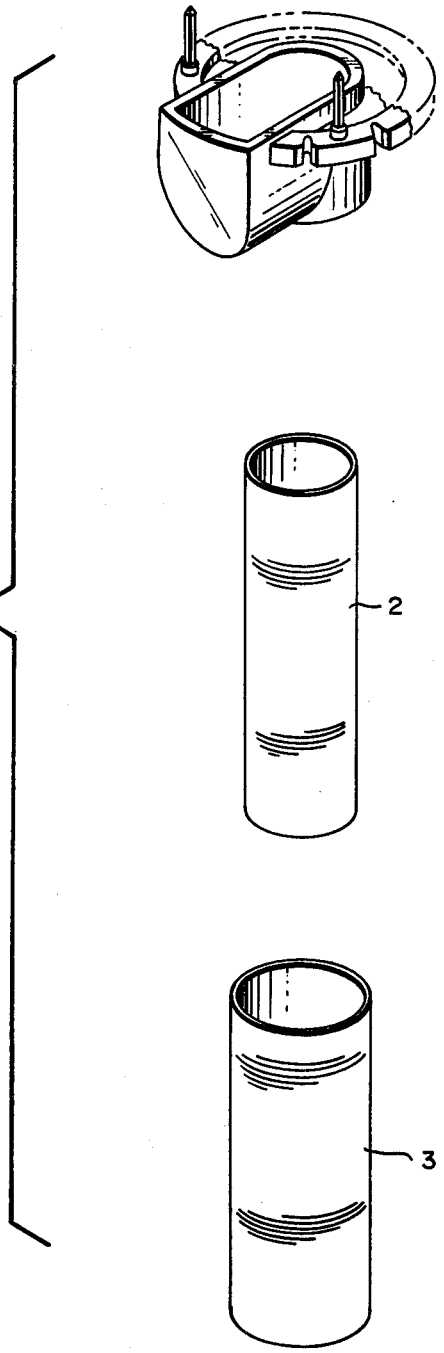
FIG. 1A is a telescoped view of a winding assembly to be used in the flyback transformer of this invention.
Figure 1B:
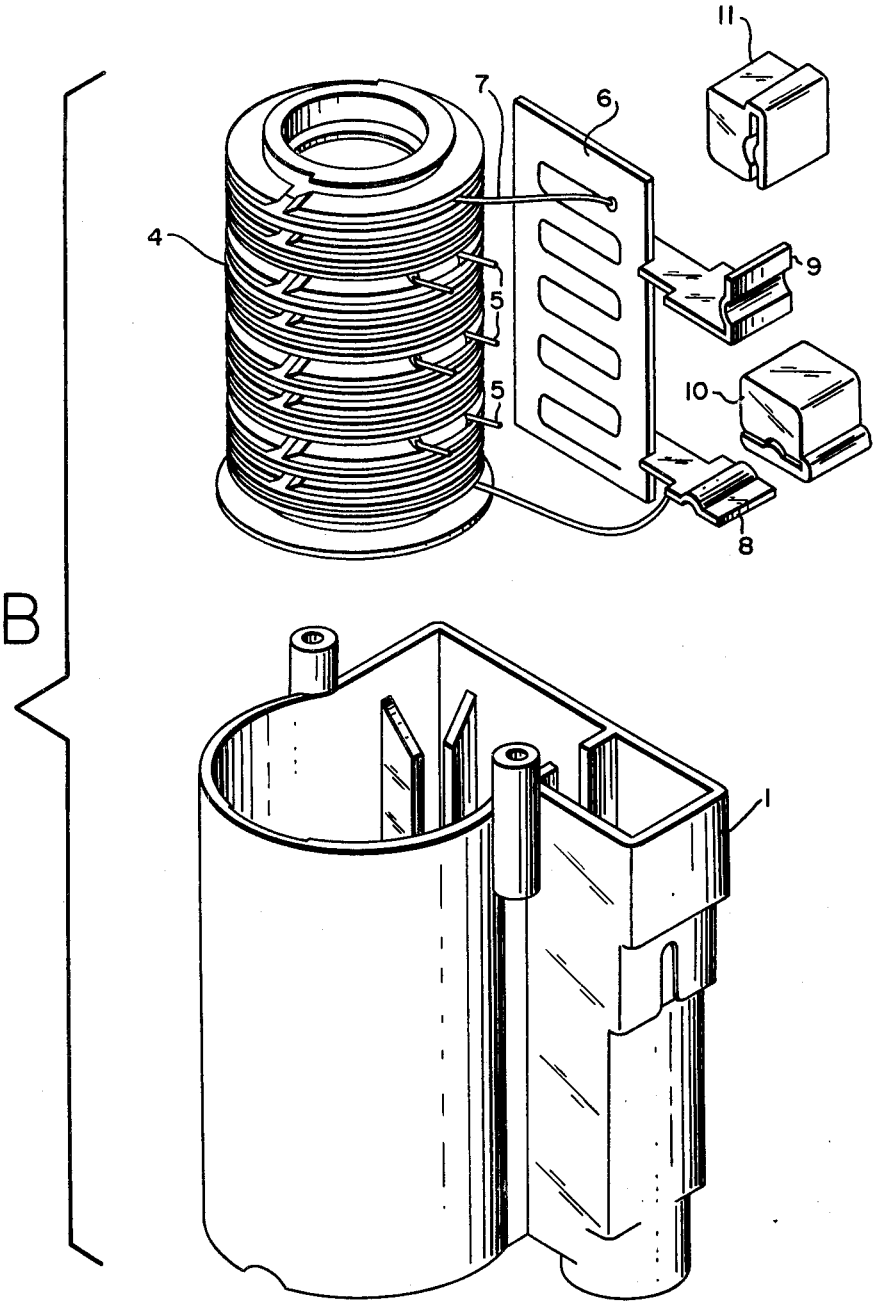
FIG. 1B is a telescoped view of the flyback transformer indicating a part of the terminal device of this invention prior to assembly.

Container 1 of FIG. 1B is adapted to hold at least primary winding 2, auxiliary windings 3 and high voltage secondary winding 4, said windings comprising a part of a flyback transformer. Winding 4 may have series connected diodes 5 connected between segments. Bleeder resistor 6 is preferably printed or deposited on a rigid card or board and container 1 may be adapted to also hold said resistor 6. Terminal 7 of resistor 6 is electrically connected to the more negative voltage terminal of secondary winding 4. The opposite terminal of resistor 6 and the opposite or high voltage terminal of secondary winding 4 are electrically coupled to high voltage conducting tab 8 which is shown as being rigidly attached by soldering or other means to the card on which resistor 6 is formed. Focus voltage conducting tab 9 is electrically coupled to a predetermined tapped point on resistor 6 and is also rigidly attached by soldering or other means to the card on which said resistor is formed. Tabs 8 and 9 are shown in greater detail in FIG. 2. Each of said tabs has a first tab surface which is positioned substantially parallel to a predetermined exterior surface of container 1.

Tabs 8 and 9 are respectively positioned in non-conductive tab casing means 10 and 11. The dimensions of tab casing means 10 and the position of tab 8 on resistor card 6 are such that when resistor card 6 is placed in mating slots of container 1, a first casing surface of casing means 10 will be positioned substantially adjacent to an interior surface located, for example, on the bottom of container 1. In a similar manner, the dimensions of tab casing means 11 and the position of the tab 9 on card 6 are such that when card 6 is placed in mating slots of container 1, a first casing surface of casing means 11 will be positioned substantially adjacent to an interior surface located, for example, on the side of container 1. Said interior surfaces are, of course, located on the opposite side of the container wall from predetermined locations of exterior surfaces.

Figure 2:
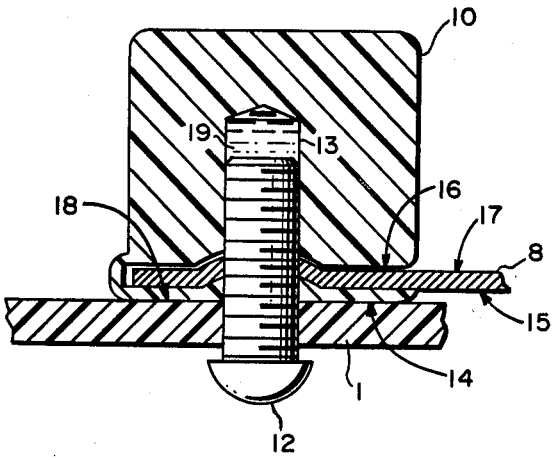
FIG. 2 is a cross-section of the terminal device of this invention after assembly.

FIG. 2 illustrates in cross-section one of the terminals after insertion of conducting terminal pin 12 into hole 13 after hole 13 has been drilled to extend from the outer surface through the wall of container 1 through casing means 10 and at least through tab 8. A similar explanation applies to the terminal associated with tab 9.

Referring again to FIG. 2, casing means 10 extends to partially surround tab 9 with second casing surface 14 positioned substantially adjacent to first tab surface 15 and with third casing surface 16 positioned substantially adjacent to second tab surface 17. Second tab surface 17 is located opposite first tab surface 15 on tab 9. Casing means 10 is, of course, comprised of non-conductive material such as molded plastic which extends from first casing surface 18 to second casing surface 14.

Conducting pin 12 may be a metal fastening screw which is driven into hole 13 to at least first tab surface 15, making electrical contact with tab 9. Because of the tendency of air to ionize under conditions of high field intensity and certain humidity conditions, and because of the danger of the volume of ionized air increasing rapidly, hole 13 is preferably filled with a high temperature non-conducting grease 19 prior to insertion of terminal pin 12, thereby eliminating air cavities in the terminal.

While there has been shown and described what are at present considered the preferred embodiments of the invention, it will be obvious to those skilled in the art that various changes and modifications may be made therein without departing from the scope of the invention as defined by the appended claims.

We claim:

1. A combination comprising a high voltage terminal, a television receiver high voltage circuit, said circuit including a secondary winding of a flyback transformer enclosed in a resin-filled, non-conductive container characterized by a conducting tab electrically coupled to a high voltage end of said secondary winding; said tab located inside said container to have a first tab surface positioned substantially parallel to an exterior surface of said container; a non-conductive casing means having a first casing surface positioned substantially adjacent to an interior surface opposite said exterior surface of said container and a second casing surface positioned substantially adjacent to said first tab surface; said casing means extending from said first casing surface to said second casing surface and extending to partially surround said tab to provide a third casing surface positioned substantially adjacent to a second tab surface opposite said first tab surface; said container, said casing and said tab having a hole extending from said outer surface to at least said second tab surface; a conducting pin extending through said hole at least from said outer surface to said first tab surface, said conducting pin making electric contact with said tab.

2. The combination of claim 1 characterized by high temperature grease substantially filling voids between said conducting pin and said hole.

* * * * *